United States Patent [19]

Wilson

[11] 4,163,981

[45] Aug. 7, 1979

[54] SPRING TUNABLE HELICAL WHIP ANTENNA

[76] Inventor: Thomas J. Wilson, 1055 N. First Pl., Hermiston, Oreg. 97838

[21] Appl. No.: 890,420

[22] Filed: Mar. 27, 1978

[51] Int. Cl.[2] ..... H01Q 1/36; H01Q 1/32

[52] U.S. Cl. ..... 343/715; 343/752; 343/895

[58] Field of Search ..... 343/752, 895, 715, 750

[56] References Cited

U.S. PATENT DOCUMENTS

| | | | |
|---|---|---|---|
| 1,581,133 | 4/1926 | Mackenzie | 343/895 |
| 2,966,678 | 12/1960 | Harris | 343/895 |
| 2,966,679 | 12/1960 | Harris | 343/895 |
| 3,624,662 | 11/1971 | Feder | 343/715 |
| 3,858,220 | 12/1974 | Arnow | 343/895 |

*Primary Examiner*—Eli Lieberman

*Attorney, Agent, or Firm*—Kolisch, Hartwell, Dickinson & Stuart

[57] ABSTRACT

A spring tunable antenna for mounting to the frame of a vehicle. The antenna includes a base adapted to be mounted on the vehicle, a flexible rod supported at its lower end in the base, and a low-resistance wire conductor wound helically around the rod. The conductor windings in the tip region of the rod are selectively movable, whereby the antenna may be tuned.

2 Claims, 8 Drawing Figures

SPRING TUNABLE HELICAL WHIP ANTENNA

BACKGROUND AND SUMMARY

The following invention relates to antennas, and in particular, vehicle antennas designed for use with citizen band radios.

Citizen band (CB) radio generally refers to short-distance broadcast and receiving equipment operating in the broadcast frequency between 26.9 and 27.7 megahertz. CB radio waves in this frequency range are typically divided into forty discreet broadcast bands, each having a wavelength close to 36 meters. The optimal antenna length for radiating and receiving such waves is thus about 36 feet.

Efficient CB antennas suitable for vehicles may be constructed as quarter or eighth wavelength antennas. For example, the so-called "108 whip", having a 108 inch length, is a quarter wavelength CB antenna. Antennas of this type may be further equipped with an adjustable tip which is variable to change the total length of the antenna for achieving optimal tuning at a desired CB frequency band.

Alternatively, CB antennas suitable for vehicle mounting may be constructed by wrapping an approximately 36 foot length of low-resistance wire conductor about a short antenna rod. Optimally, the wire conductor is helically wound around the rod, although overlapping coiled windings may also be employed. An antenna of this type is equivalent to an L-C circuit having an induction coil and capacitor in parallel. The antenna may be tuned by varying the inductance of the antenna, e.g., by changing the length of the coil or varying the number of coil windings.

The performance of the CB antenna can be further enhanced by optimal impedance matching between antenna and CB radio equipment. From the above, it is evident that the impedance of a helically-wound antenna may also be varied by changing the length of the coil and/or the number of helical windings on the antenna.

It is an object of the present invention to provide a tunable helically-wound radio antenna designed for mounting to vehicles, boats or the like.

Specifically, it is an object of the invention to provide a helical whip-type antenna which can be tuned to CB radio bands.

It is another object of the invention to provide an antenna having a selectively variable impedance.

Yet another object of the invention is to provide a helically-wound antenna which is lightweight, durable, and inexpensive in manufacture.

The antenna of the present invention comprises an antenna rod adapted for mounting to a vehicle or the like, and a low-resistance wire conductor wound helically about the rod. The conductor windings in the tip region of the rod are selectively movable to vary the frequency response and the inductive impedance of the antenna.

DRAWINGS

These and other objects and features of the present invention will be more fully described with reference to the following detailed description of the invention and the accompanying drawings, wherein.

DETAILED DESCRIPTION OF A PREFERRED EMBODIMENT OF THE INVENTION

Figure 1:
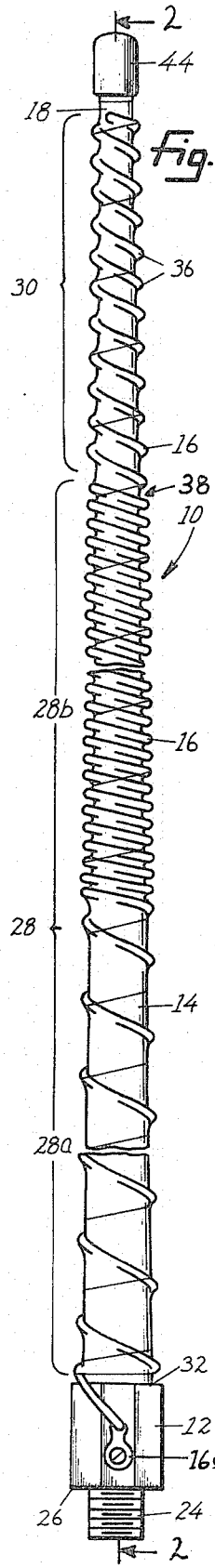
FIG. 1 is a side elevation view of a preferred embodiment of the invention, in which the radial dimension of the antenna has been exaggerated for illustrative purposes.
Figure 2:
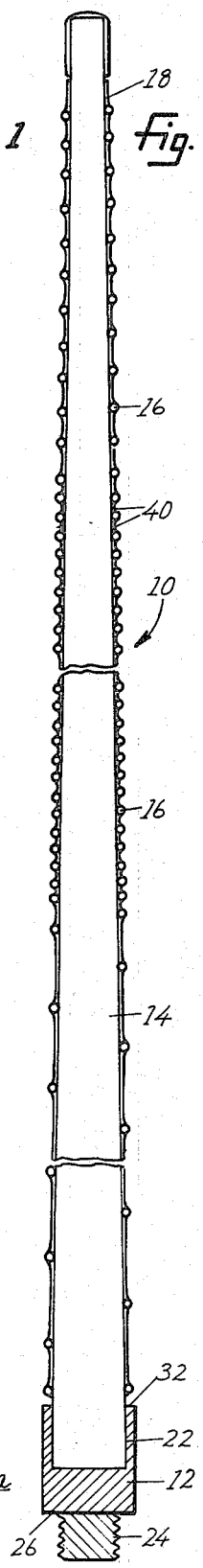
FIG. 2 is a sectional view of the antenna taken generally along line 2—2 of FIG. 1.

Referring first to FIGS. 1 and 2, there is shown at 10 the tunable antenna of the present invention. The antenna generally comprises a base 12, a rod 14 attached at its lower end to the base, and a low-resistance conductor 16 wound helically about the rod. The helical conductor windings are encased in helical wrappings of a weatherproof tape covering 18.

Base 12 is a conventional antenna mounting base having an upper cylindrical cavity 22 for receiving therein the lower end of rod 14. Typically the lower rod end is glued within this cavity with a resinous glue. The base further includes a lower threaded member 24 by which the base may be threadedly mounted in a conventional vehicle-mounted antenna socket (not shown). Alternatively, lower threaded member 24 may be inserted through an opening in a plate metal surface, such as a vehicle fender, and clamped thereto between the lower face 26 of the base and a nut (not shown) threadably engaging the threaded member.

Rod 14 is preferably a flexible fiberglass or teflon rod having a slight taper on progressing upwardly. For purposes of description, rod 14 is divided into a body region 28 and a tip region 30. Body region 28 is further divided into lower and upper body regions **28*a* and 28*b* of roughly equal lengths. The length of the tip region is typically less than the length of body regions 28*a* or 28*b***.

Low-resistance conductor 16 is preferably a copper wire attached at **16*a* to base 12 to form an electrical connection therewith. The wire is helically wrapped around rod 14, forming a plurality of helical windings 36 encircling the rod. The windings adjacent the upper end of upper body region 28*b* are adhesively fastened to the rod at 38, preferably by a spot of resinous glue 40., thus securing the helical windings along the body region of the rod in fixed positions. As seen in FIG. 1, the pitch, or interwinding spacing of the windings in the lower body region 28*a* is substantially greater than the pitch of windings in the upper body region 28*b*. The conductor wire forming windings 36** encircling the body region of the antenna may be covered or coated with an insulating material.

The portion of helically wound conductor positioned above glued region 38 is referred to herebelow as a coiled spring 42. Preferably the portion of conductor forming coiled spring 42 is uninsulated, as explained below. Anchored at its lower end at 38, spring 42 is selectively variable between a compressed position encircling a lesser portion of the tip region, and an extended position encircling a greater portion of the tip region. In the compressed position, the pitch of the coiled spring windings is less than the pitch of the windings encircling upper body portion 28*b*. When spring 42 is extended, the pitch of coiled spring windings is greater than the pitch of windings in upper body region 28*b*, but less than the pitch of windings in lower body region 28*a*.

Covering 18 serves to protect the wire windings from physical damage and exposure. The covering also serves as means for securing the selectively adjustable windings of coiled spring 42 in a desired configuration. Preferably covering 18 is a weather-proof tape, such as teflon or polyethylene tape, wrapped helically about the antenna windings. The tape is securely wound about the body region of the rod and removably wound about the tip region. Explaining further, the tape wrappings about the body region are adhesively wrapped to prevent unwinding, whereas the wrappings about the tip region may be alternately wrapped or unwrapped, to expose coiled spring 42. The tape may be secured at the upper end of the rod by cap means including a cap 44 which fits snugly over the end of the rod.

Figure 3:
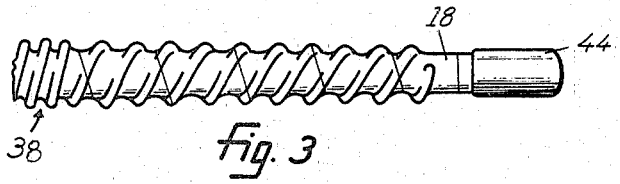
FIG. 3 shows the antenna tip region of the antenna of FIG. 1, with the helical windings encircling a major portion of the tip region.
Figure 4:
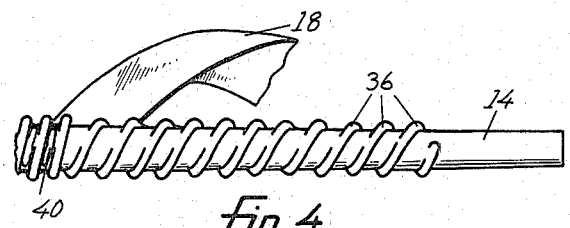
FIG. 4 shows the antenna tip region of FIG. 3 with the tape removed to permit tuning of the antenna.
Figure 5:
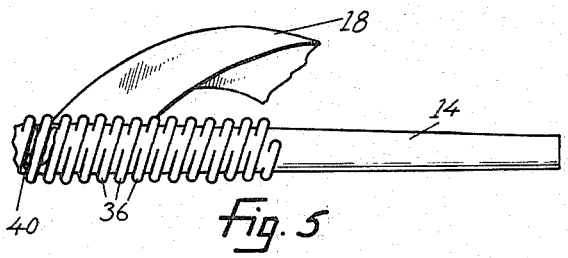
FIG. 5 shows the antenna tip region of FIG. 4 with the helical windings compressed to encircle about half of the tip region.
Figure 6:
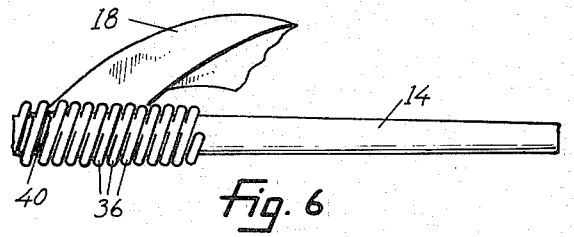
FIG. 6 shows the antenna tip region of FIG. 4 with the helical windings compressed to encircle a minor portion of the tip region.

In FIGS. 3–8, there is shown the antenna tip region 30 distal of glued region 38. In FIG. 3, coiled spring 42 is extended to cover a major portion of the tip region, as in FIGS. 1 and 2. The tip region is shown helically wrapped with removable tape covering 18, which is secured thereto by cap 44. To adjust the pitch of the coiled spring, cap 44 is removed and the tape covering 18 is unwound from the tip region to expose spring 42, as seen in FIG. 4. The coiled spring may now be adjusted to variously compressed positions, as seen in FIGS. 5 and 6, wherein the helical windings of the coiled spring encircle variable portions of tip region 30. As the coiled spring is compressed, the pitch between adjacent spring windings is decreased, thus increasing the inductive impedance, and decreasing the resonance frequency, of the antenna.

Figure 7:
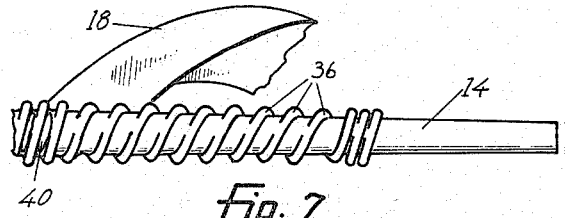
FIG. 7 shows the antenna tip region of FIG. 4 with end windings pressed together.

Further to tune the antenna, it may be advantageous to vary the effective length of the conductor wire 16. At the lower CB frequency 26.9 megahertz the optimal antenna length is about 36.5 feet, whereas the optimal antenna length at the higher CB frequency 27.7 megahertz is about 36 feet. The effective length of conductor 16 may be shortened by compressing into mutual contact two or more adjacent tip region windings 36, as illustrated in FIG. 7. In this application of the invention, coiled spring 42 cannot be insulated. As each winding is pressed into mutual contact with an adjacent winding, the effective length of the wire is reduced by the total linear length of that winding. In the present invention the linear length of each tip winding is about one inch. Thus, by compressing together three distal windings, as shown in FIG. 7, the effective length of wire 16 is reduced by about two inches.

Figure 8:
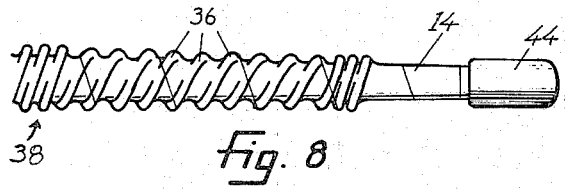
FIG. 8 shows the antenna tip region of FIG. 7 wrapped with tape.

From the above, it can be appreciated that by variously compressing or extending the coiled spring, the antenna may be frequency tuned, and the impedance matching between antenna and radio equipment may be optimized. Following adjustment of the spring to achieve maximal antenna performance, tape covering 18 is helically wrapped about the tip regions to secure the spring windings at the desired adjusted position, and the cap replaced over the end of the tape covering, as illustrated in FIG. 8.

A novel antenna adapted for use on a vehicle or boat which can be spring tuned for high performance, has thus been disclosed. It is understood that other modifications and alternative construction may be used without departing from the true spirit and scope of this invention.

It is claimed and desired to secure by Letters Patent:

1. A spring tunable antenna mountable on the frame of a vehicle or the like comprising, a base mountable on the vehicle, a flexible rod mounted at one of its ends on said base, said rod having a tip region opposite said one end, and a body region intermediate said base and said tip region, a low-resistance conductor attached to said base and wound helically about said rod to form a plurality of helical windings encircling said rod, said windings encircling said body region having substantially fixed positions relative thereto, and said windings encircling said tip region forming a coiled spring which is adjustable selectively between compressed and extended position, wherein said spring encircles lesser and greater portions of said tip region, respectively, and means for securing said spring at a preselected position between said compressed and extended positions, said means including a tape which is securable about said spring to encase the same in a plurality of helical wrappings, and which is releasable selectively to permit adjustment of said spring.

2. The antenna of claim 1 wherein said means further includes cap means selectively placeable over a portion of said tip region and said wrappings to prevent the latter from being released.

* * * * *